US007107734B2

(12) United States Patent
Jines et al.

(10) Patent No.: US 7,107,734 B2
(45) **Date of Patent: *Sep. 19, 2006**

(54) AUDIENCE SEATING SYSTEM

(75) Inventors: Michael D. Jines, Owatonna, MN (US); Steven E. Wiese, Owatonna, MN (US)

(73) Assignee: Wenger Corporation, Owatonna, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/167,571

(22) Filed: Jun. 27, 2005

(65) Prior Publication Data

US 2005/0252095 A1 Nov. 17, 2005

Related U.S. Application Data

(63) Continuation of application No. 10/819,057, filed on Apr. 6, 2004, now Pat. No. 6,922,947, which is a continuation of application No. 10/003,460, filed on Oct. 18, 2001, now Pat. No. 6,729,075.

(60) Provisional application No. 60/241,588, filed on Oct. 19, 2000.

(51) Int. Cl.
*E04H 3/12* (2006.01)

(52) U.S. Cl. ..... 52/655.1; 52/7; 52/656.9; 403/170; 248/165

(58) Field of Classification Search ..... 52/6–9, 52/653.1, 655.1, 656.9, 702, 263; 248/165; 108/180; 211/206; 256/65.02, 65.03; 403/170, 403/187, 219

See application file for complete search history.

(56) References Cited

U.S. PATENT DOCUMENTS 704,590 A 7/1902 Stimson et al.
1,514,055 A 11/1924 Lawson (Continued)

FOREIGN PATENT DOCUMENTS

FR 2 350 452 12/1977

(Continued)

*Primary Examiner*—Robert Canfield
(74) *Attorney, Agent, or Firm*—Patterson, Thuente, Skaar & Christensen, P.A.

(57) ABSTRACT

An interface for connecting supporting members of an audience seating system including an end plate secured to the first end of a horizontal member. The end plate includes a downwardly extending tongue and outwardly extending tabs and a hook member extending outwardly and downwardly. The upper end of the vertical member has a recess dimensioned to receive the hook member and a hanger bracket defining a space for receiving the tongue and openings for receiving the tabs. The horizontal member may be engaged to the vertical member by lowering the hook member into the recess, the tongue into the space and the tabs into the openings to create a substantially rigid engagement secured by gravity.

14 Claims, 20 Drawing Sheets

U.S. PATENT DOCUMENTS 1,521,803 A 1/1925 Dossenbach
2,362,170 A 11/1944 Swaisgood
2,377,994 A 6/1945 Cocken, Jr.
2,512,150 A 6/1950 Geren
2,658,233 A 11/1953 Kimmel
2,798,652 A 7/1957 Easton
2,841,831 A 7/1958 Mackintosh
2,851,311 A 9/1958 Gibbs
2,981,365 A 4/1961 Olsen
3,015,839 A 1/1962 Eskridge et al.
3,035,671 A 5/1962 Sicherman
3,094,848 A 6/1963 Albrecht
3,099,336 A 7/1963 Hawkins
3,157,254 A 11/1964 Spiselman et al.
3,158,748 A 11/1964 Liskey, Jr.
3,168,793 A * 2/1965 Gibson ..... 446/127
3,180,460 A 4/1965 Liskey, Jr.
3,181,203 A 5/1965 Wengar
3,217,366 A 11/1965 Wenger
3,258,884 A 7/1966 Wenger
3,311,996 A 4/1967 Bergener
3,372,518 A 3/1968 Reusch
3,400,502 A 9/1968 Scaggs et al.
3,417,518 A 12/1968 Jaffe
3,425,179 A 2/1969 Haroldson
3,470,663 A 10/1969 Tate
3,488,898 A 1/1970 Scaggs
3,564,790 A 2/1971 Rehfeld
3,599,382 A 8/1971 Stone, Jr.
3,620,564 A 11/1971 Wenger et al.
3,747,706 A 7/1973 Paine et al.
3,747,708 A 7/1973 Wenger et al.
3,908,787 A 9/1975 Wenger et al.
3,964,402 A 6/1976 Jenné
3,971,181 A 7/1976 Zetlin
3,974,894 A 8/1976 Wenger et al.
4,026,221 A 5/1977 Wilson et al.
4,039,264 A * 8/1977 Sharp ..... 403/246
4,050,257 A 9/1977 Parks et al.
4,054,096 A 10/1977 Wilson et al.
4,232,488 A 11/1980 Hanley
RE30,830 E 12/1981 Wenger et al.
4,319,520 A 3/1982 Lanting et al.
4,327,650 A 5/1982 Bue
4,369,859 A * 1/1983 Smits ..... 182/186.8
4,409,762 A 10/1983 Raymond
4,445,307 A * 5/1984 Puccinelli et al. ..... 52/638
4,467,569 A 8/1984 Blanchard et al.
4,535,933 A 8/1985 Kuiper
4,571,895 A 2/1986 Lyman
4,580,776 A 4/1986 Burkinshaw
4,586,842 A * 5/1986 Puccinelli ..... 403/246
4,596,196 A 6/1986 Gunter et al.
4,630,417 A 12/1986 Collier
4,638,604 A 1/1987 Rogers et al.
4,656,795 A 4/1987 Albrecht et al.
4,676,036 A 6/1987 Bessert
4,685,258 A 8/1987 Av-Zuk
4,720,945 A 1/1988 Berranger et al.
4,759,162 A 7/1988 Wyse
4,768,617 A 9/1988 Mason et al.
4,779,542 A 10/1988 Staten et al.
4,811,530 A 3/1989 Eyerly
4,813,201 A 3/1989 Parsons et al.
4,825,976 A 5/1989 Wyse
4,852,213 A 8/1989 Shewchuk
D304,499 S 11/1989 Rogers et al.
4,895,548 A * 1/1990 Holland et al. ..... 446/476
4,901,490 A 2/1990 Zinniel et al.
D307,186 S 4/1990 Rogers et al.
4,912,887 A 4/1990 Sullivan
4,917,217 A 4/1990 Rogers et al.
4,919,230 A 4/1990 Langer et al.
4,922,670 A 5/1990 Naka et al.
4,930,277 A 6/1990 Krumholz et al.
4,934,113 A 6/1990 Hall et al.
4,942,708 A 7/1990 Krumholz et al.
4,949,649 A 8/1990 Terres et al.
4,959,935 A 10/1990 Stob
4,979,340 A 12/1990 Wilson et al.
5,022,490 A 6/1991 Wyse
5,050,353 A 9/1991 Rogers et al.
5,078,442 A 1/1992 Rau et al.
5,078,532 A * 1/1992 Williams ..... 403/246
5,117,596 A 6/1992 Leslie et al.
5,152,109 A 10/1992 Boers
5,157,890 A 10/1992 Jines
5,177,913 A 1/1993 Erel
5,205,087 A 4/1993 Jines
RE34,468 E 12/1993 Rau et al.
5,301,480 A 4/1994 Oyama et al.
5,317,842 A 6/1994 Rogers et al.
5,325,640 A 7/1994 Luedke et al.
5,343,817 A 9/1994 Abraham et al.
5,349,789 A 9/1994 Andert et al.
5,381,873 A 1/1995 Kniefel et al.
5,392,718 A 2/1995 Stevens
5,787,647 A 8/1998 Dettmann et al.
5,848,501 A 12/1998 Taipale et al.
5,901,505 A 5/1999 Dettmann et al.
6,006,680 A 12/1999 Quam et al.
6,014,936 A 1/2000 Rogers et al.
6,106,186 A 8/2000 Taipale et al.
6,390,719 B1 * 5/2002 Chan ..... 403/205
6,539,672 B1 4/2003 Frost
6,729,075 B1 5/2004 Jines et al.
6,922,947 B1 * 8/2005 Jines et al. ..... 52/7
2003/0009950 A1 1/2003 Hallberg

FOREIGN PATENT DOCUMENTS

FR 2 418 319 9/1979
FR 2 585 752 6/1987
GB 755735 8/1956
WO WO 89/08760 9/1989

* cited by examiner

AUDIENCE SEATING SYSTEM

RELATED APPLICATION

This application is a continuation of application Ser. No. 10/819,057 filed Apr. 6, 2004, now U.S. Pat. No. 6,922,947 issued Aug. 02, 2005, which is a continuation of application Ser. No. 10/003,460 filed Oct. 18, 2001, now U.S. Pat. No. 6,729,075 issued May. 4, 2004, which claims the benefit of U.S. Provisional Application Ser. No. 60/241,588 filed Oct. 19, 2000.

FIELD OF THE INVENTION

The invention relates to portable modular seating and staging systems for use in arenas, theaters, and assembly halls.

BACKGROUND OF THE INVENTION

Arenas, theaters, and assembly halls often require seating that can be installed and removed at will to accommodate varying seating needs for varying events. There are many such systems already in existence.

Many existing designs are of the type of retractable bleacher grandstands with integral seats commonly seen in high school gymnasiums. Other systems use a supporting structure of platforms upon which may be placed separate folding chairs. Most of the existing designs for portable arena seating have few options. In general, systems are configured to be assembled and placed in a certain configuration and that configuration is generally not alterable. Most of the existing systems are relatively inflexible in design.

U.S. Pat. No. 5,050,353 issued to Rogers et al discloses a system for multilevel staging and seating support. The Rogers system utilizes relatively large components. The disclosure indicates that components may weigh as much as 140 pounds. It would be desirable to keep the components of a system as light as possible to facilitate assembly, disassembly and transport of the system. Further the Rogers system is relatively inflexible in design having a fixed width and run for each subassembly. It is desirable to be able to use individual components in a variety of staging or seating assemblies. These types of staging and seating supports lend themselves to a rental market where flexibility of construction and ease of handling components is at a premium.

It would be beneficial if a system existed that could be set up in a variety of different configurations. It would also be helpful if this system were foldable or collapsible for compact storage in a variety of different ways. Further, it would be beneficial if the seating system could be assembled easily without the need for heavy equipment to handle parts. Therefore, relatively small, lightweight components are desirable. Finally, it would be particularly beneficial if the system could be assembled with a minimal or no required for tools.

SUMMARY OF THE INVENTION

The audience seating system of the present invention largely solves the problems noted above. The audience seating system may be assembled with minimal tools required. A large portion of the assembly and disassembly can be accomplished with no tools at all. The audience seating system may be assembled in a large variety of configurations by merely selecting appropriate modules to be assembled together.

The audience seating system of the present invention takes a modular approach to creating a wide variety of seating options. The audience seating system utilizes a variety of standardized parts that can be assembled in a flexible variety of configurations. The audience seating system generally utilizes a plurality of columns, trusses, end frames, and platforms. The major parts of the system are assembled and secured together by readily removable pins to create a flexible and secure seating system. Further, a large portion of the system is held together by gravity further simplifying installation and disassembly.

By varying the size of the different components appropriately, the rise presented by the seating system may be made variable. Independently, the runs utilized in the seating system are variable as well. Rise is a term referring to the vertical height separating one level of seating from the level of seating behind it. Runs refer to the horizontal spacing between different levels of the seating arrangement.

In addition, the audience seating system of the present invention is readily storable in a variety of ways. The system may be partially disassembled and folded while retaining its major structural integrity for ready reinstallation in the same configuration. The system is also readily disassembled in order to provide more compact storage and shipment. The system provides the option of utilizing partial disassembly or complete disassembly to its most basic component parts to facilitate shipping and storage.

DETAILED DESCRIPTION OF THE DRAWINGS

Figure 1:
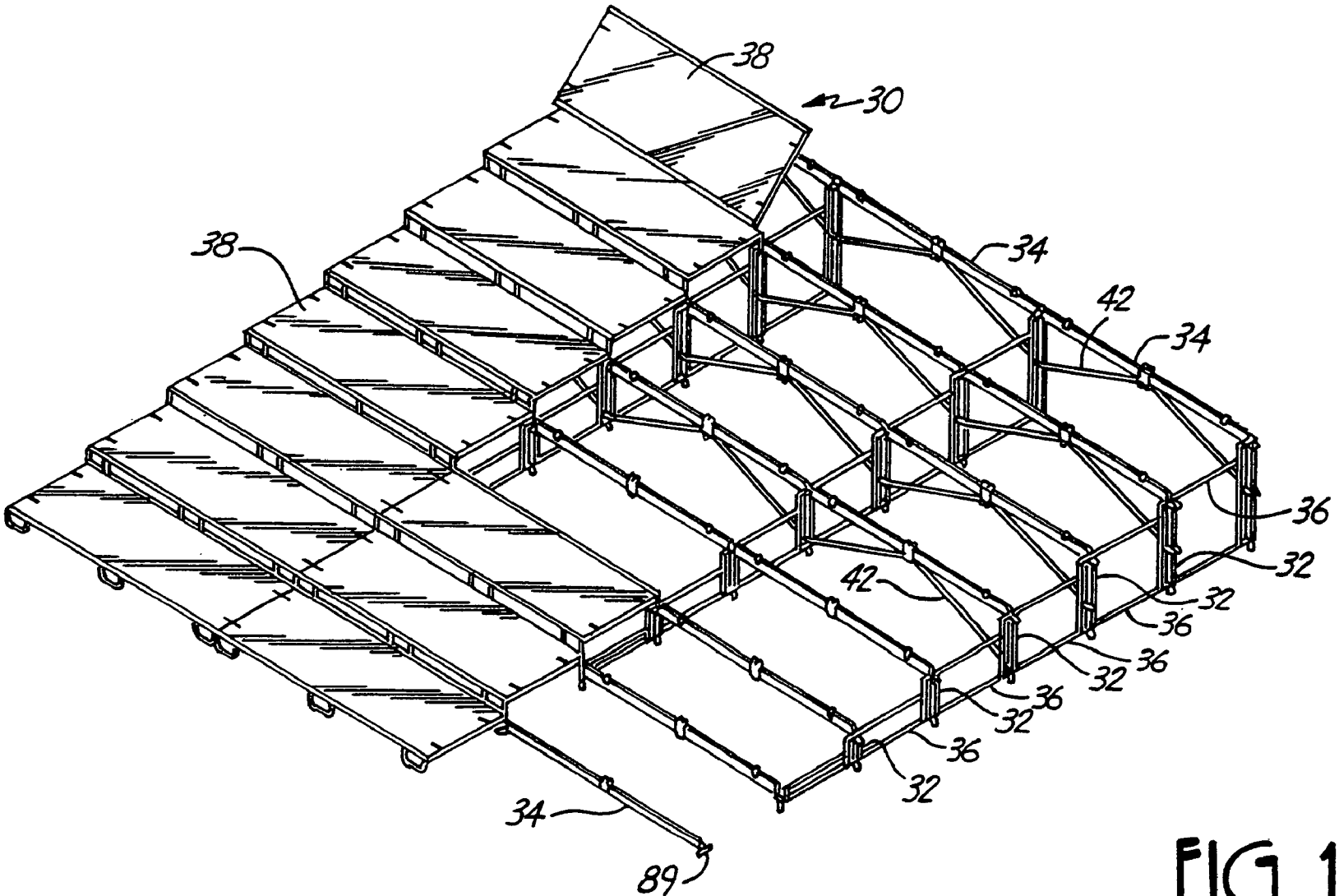
FIG. 1 is a perspective view of a representative partial assembly of an exemplary audience seating system.
Figure 2:
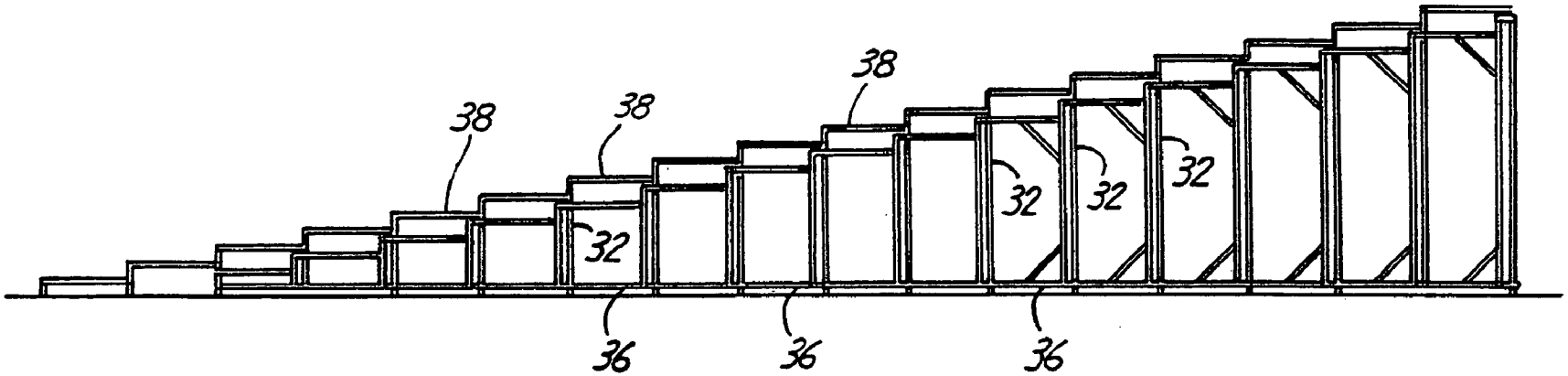
FIG. 2 is an end-elevational view of a representative assembly of the audience seating system.

Referring to FIGS. 1 and 2, the audience seating system 30 generally comprises columns 32, trusses 34, end frames 36, and platforms 38. These modular components are available in a variety of heights and lengths. All columns 32 are of generally similar structure but of varying height. End frames 36 may vary in height as well as length. Trusses 34 will generally be of similar size within a given assembly. It is specifically envisioned that these components may be made available in standardized sizes or customized sizes for differing uses. In a typical installation each row of columns 32 will vary in height by a consistent unit value equal to the desired rise for each platform 38. For example, if the desired rise is seven inches each column 32 in a given intermediate row will be seven inches taller than the column 32 in the row in front of thereof. However, the system 30 may be configured so that the rise may vary for some rows of platforms 38 as compared to others within the system. This is accomplished by choosing some rows of columns 32 so that they vary in height from the row in front of them by a unit value different from others.

Figure 3:
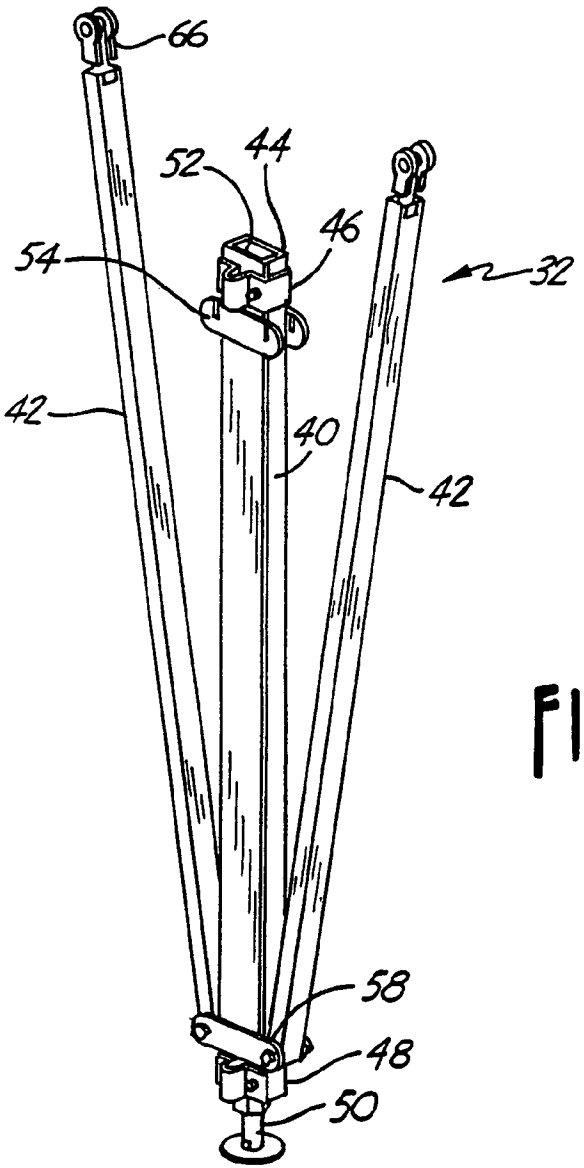
FIG. 3 is a perspective view of a typical column assembly as utilized in the present invention.

Referring to FIG. 3, a typical column 32 generally includes an upright member 40; optionally one or two sway braces 42, hanger assembly 44, top bracket 46, bottom bracket 48 and leveler 50.

Figure 4:
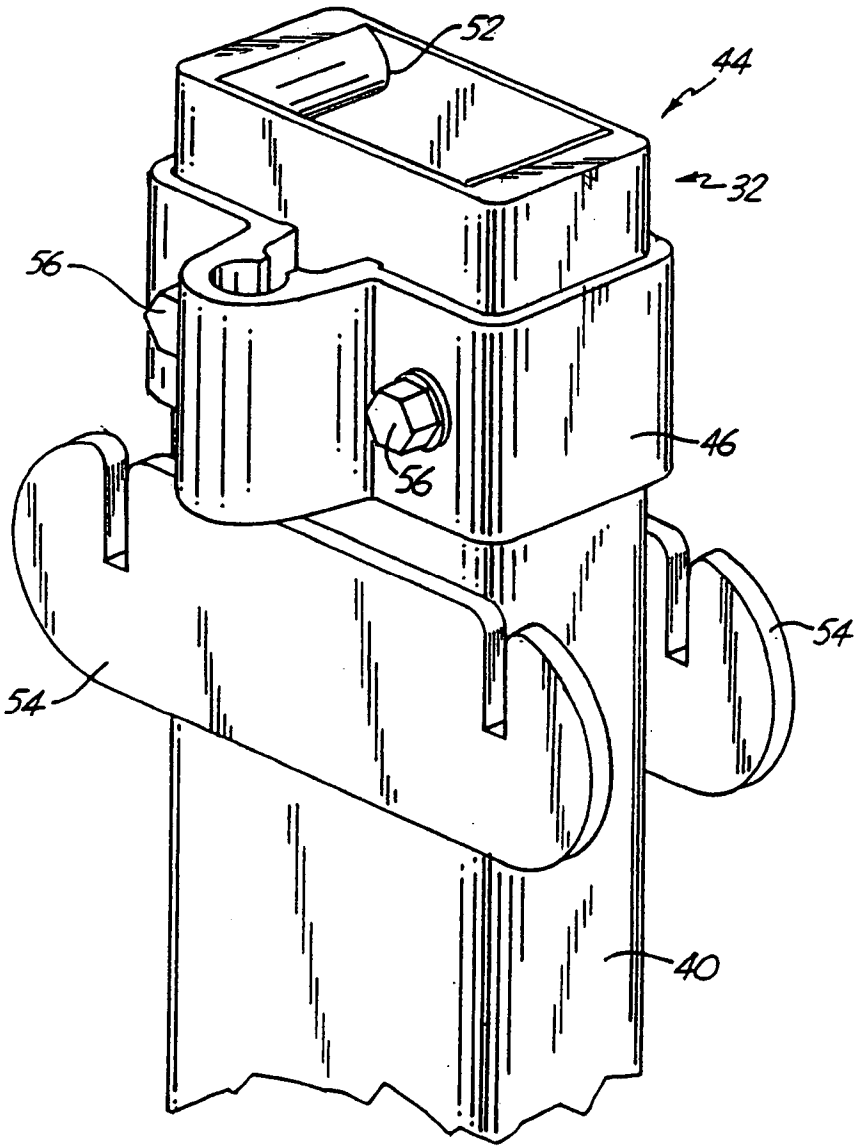
FIG. 4 is a detail view of the top of a column assembly as utilized in the present invention.

Referring to FIG. 4, the top of column 32 includes integral hanger assembly 44. Hanger assembly 44 includes hook receiver 52, and hanger bracket 54. FIG. 4 also depicts top bracket 46. Top bracket 46 is preferably an aluminum alloy extrusion and is preferably secured to upright member 40 by bolt 56.

Figure 5:
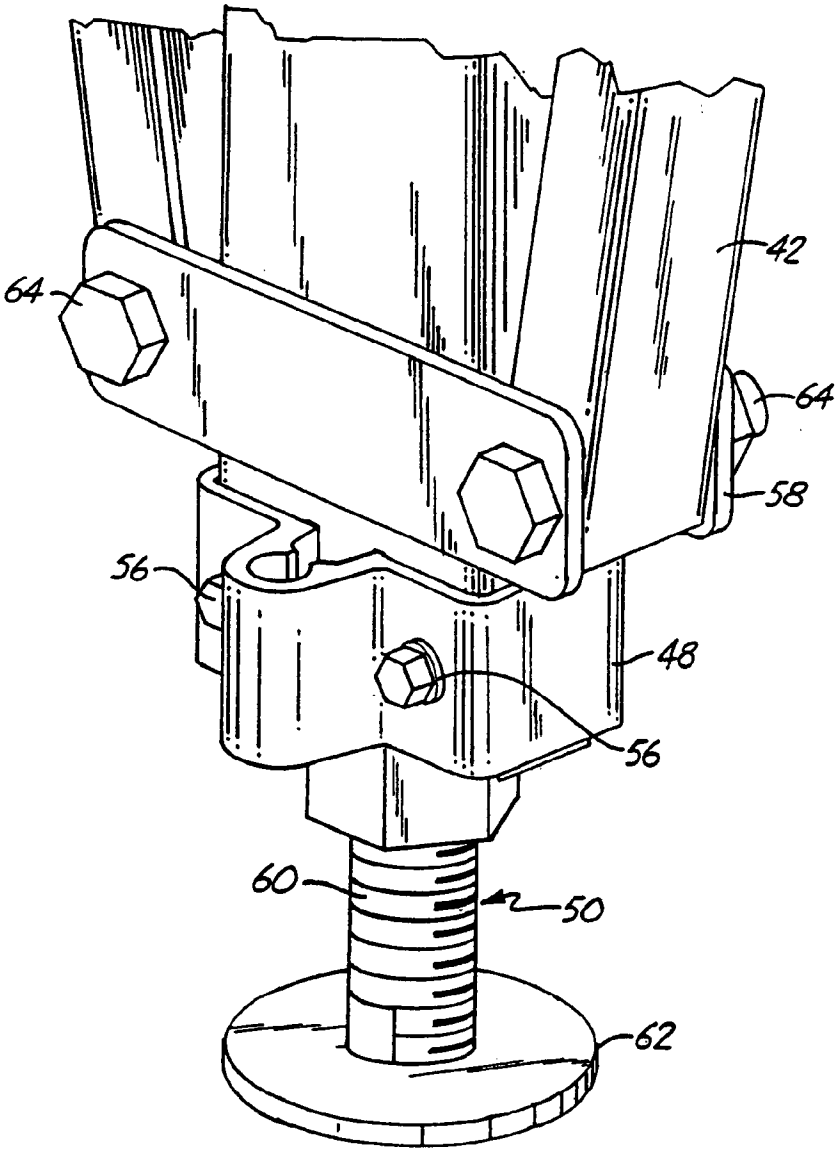
FIG. 5 is a detail view of the bottom of a column assembly.

Referring to FIG. 5, the bottom of column 32 is depicted. The bottom of column 32 includes bottom bracket 48, leveler 50, and sway brace bracket 58. Bottom bracket 48 is similar in structure to top bracket 46 and is also secured to upright member 40 by bolts 56. Sway brace bracket 58 is integrally connected to upright member 40 such as by welding. Leveler 50 may include a screw jack 60 and a floor pad 62. Other types of leveling assemblies may be employed without departing from the spirit or scope of the present invention.

Figure 6:
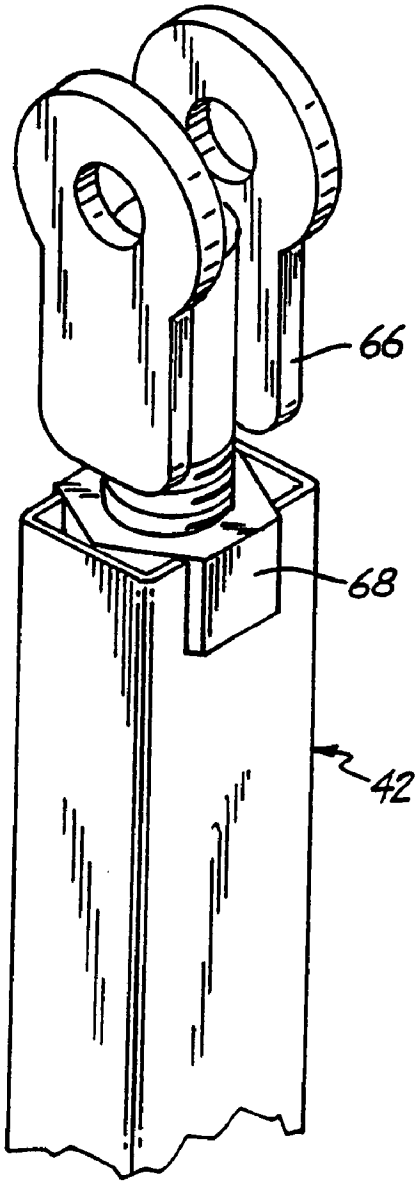
FIG. 6 is a detail view of the end of a sway brace as utilized with the column assembly.

Referring to FIGS. 3 and 5, sway braces 42 are connected to column 32 at sway brace bracket 58 by nut and bolt assembly 64. Referring to FIG. 6 details of the sway brace 42 include threaded clevis 66, threadably received into hex nut 68.

Figure 7:
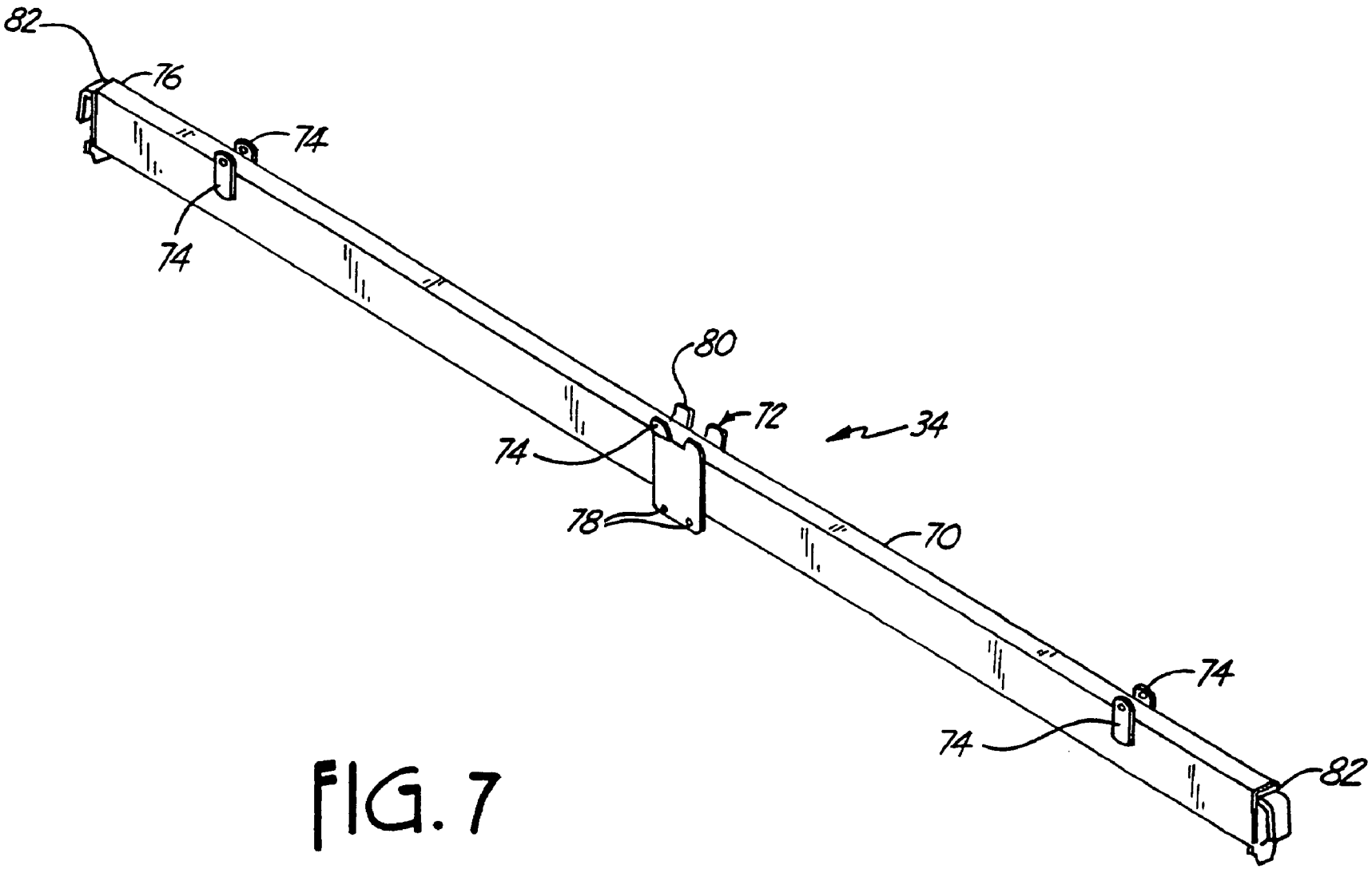
FIG. 7 is a perspective view of a typical truss as utilized in the present invention.
Figure 8:
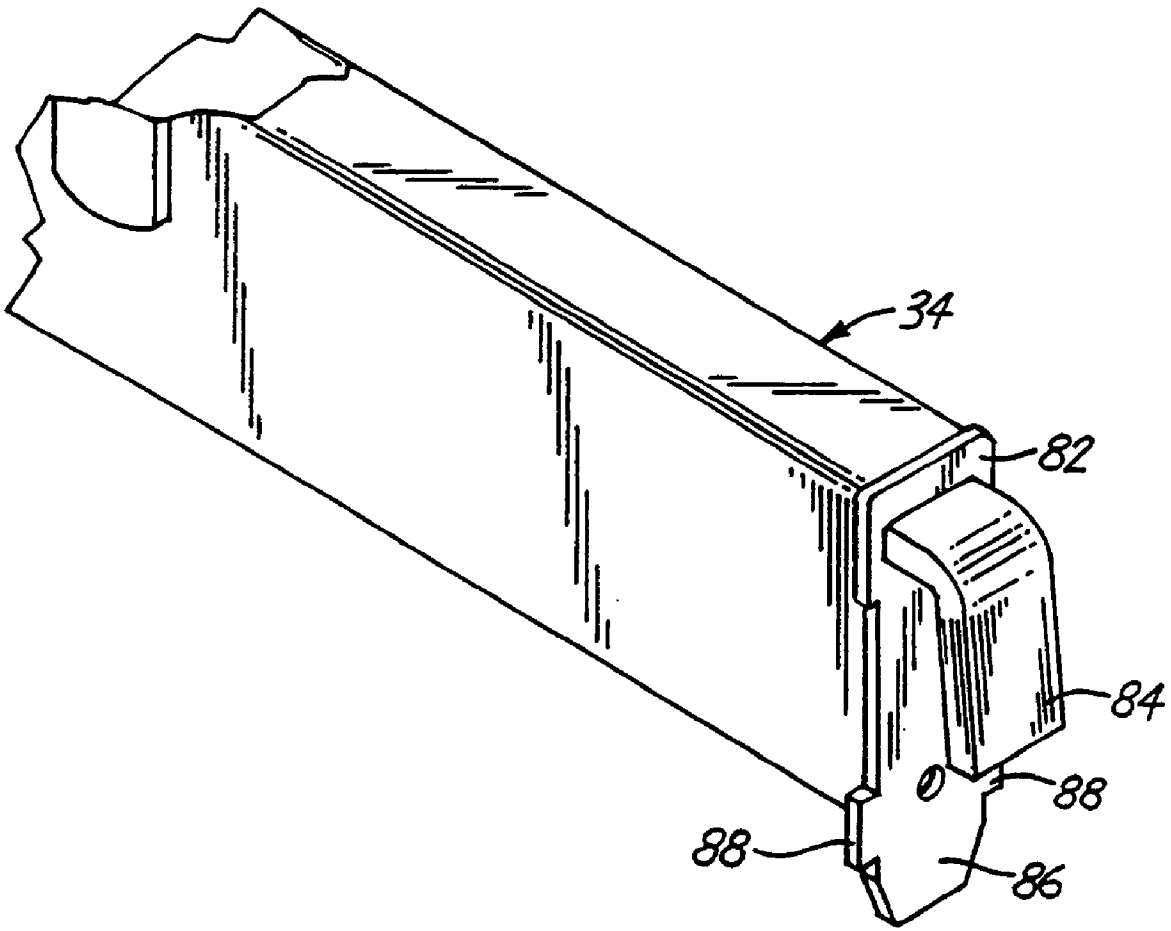
FIG. 8 is a detailed view of the end of a truss as utilized in the present invention.

Trusses 34 depicted in FIGS. 7 and 8, generally include truss girder 70, center bracket 72, tabs 74, and truss ends 76. Center bracket 72 is permanently secured to truss girder 70 and includes holes 78 and center tabs 80. Truss end 76 comprises end plate 82 which includes hook 84, tongue 86, and end tabs 88. Referring to FIG. 1, some trusses 34 may include end supports 89. End supports 89 may be secured to a truss 34 permanently such as by welding or may be removable.

Figure 9:
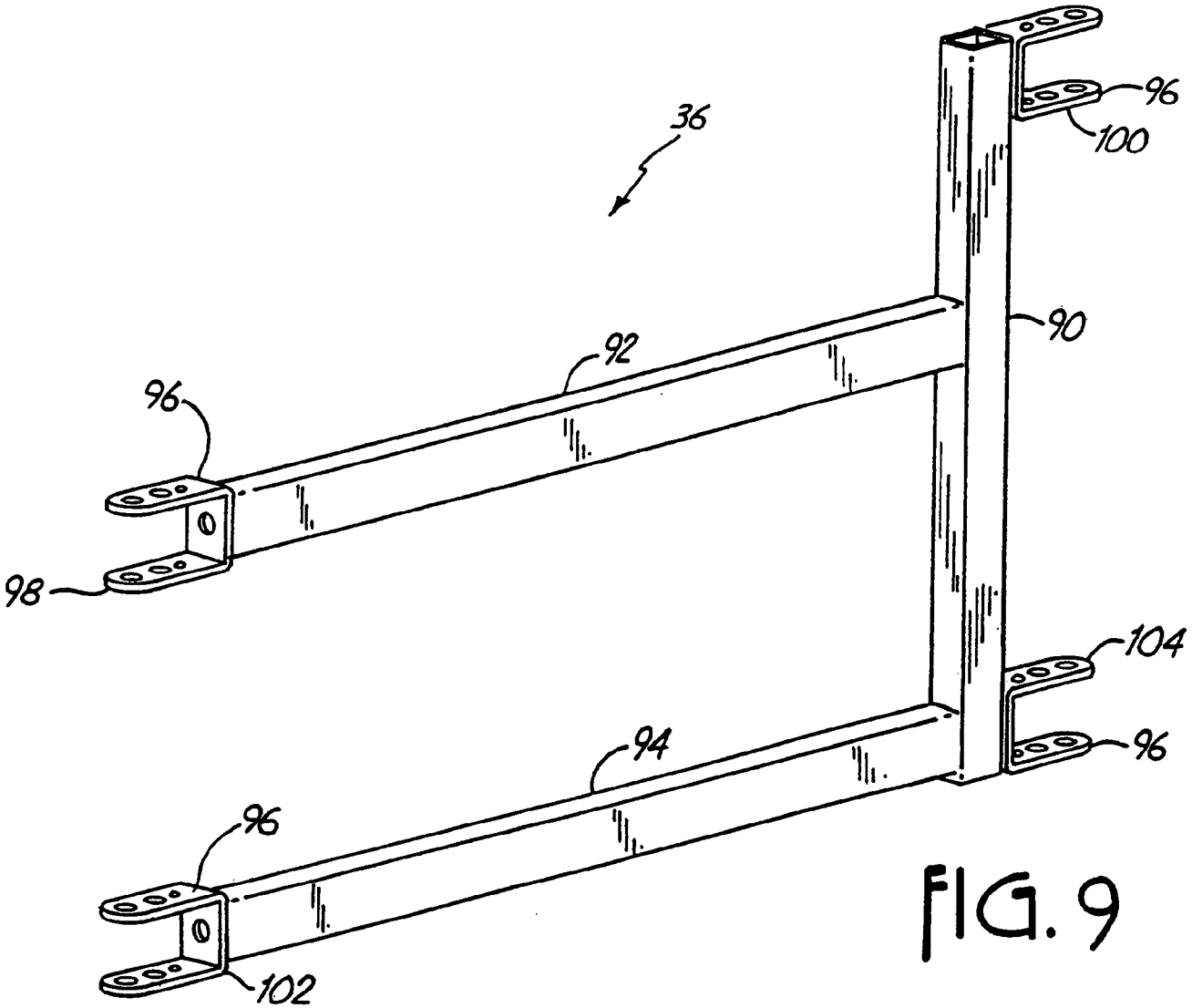
FIG. 9 depicts a typical end frame assembly as utilized in the present invention.

Referring to FIG. 9, end frames 36 generally comprise an upright member 90, an upper cross member 92, a lower cross member 94, and brackets 96. Brackets 96 include upper front bracket 98, upper rear bracket 100, lower front bracket 102, and lower rear bracket 104.

Figure 10:
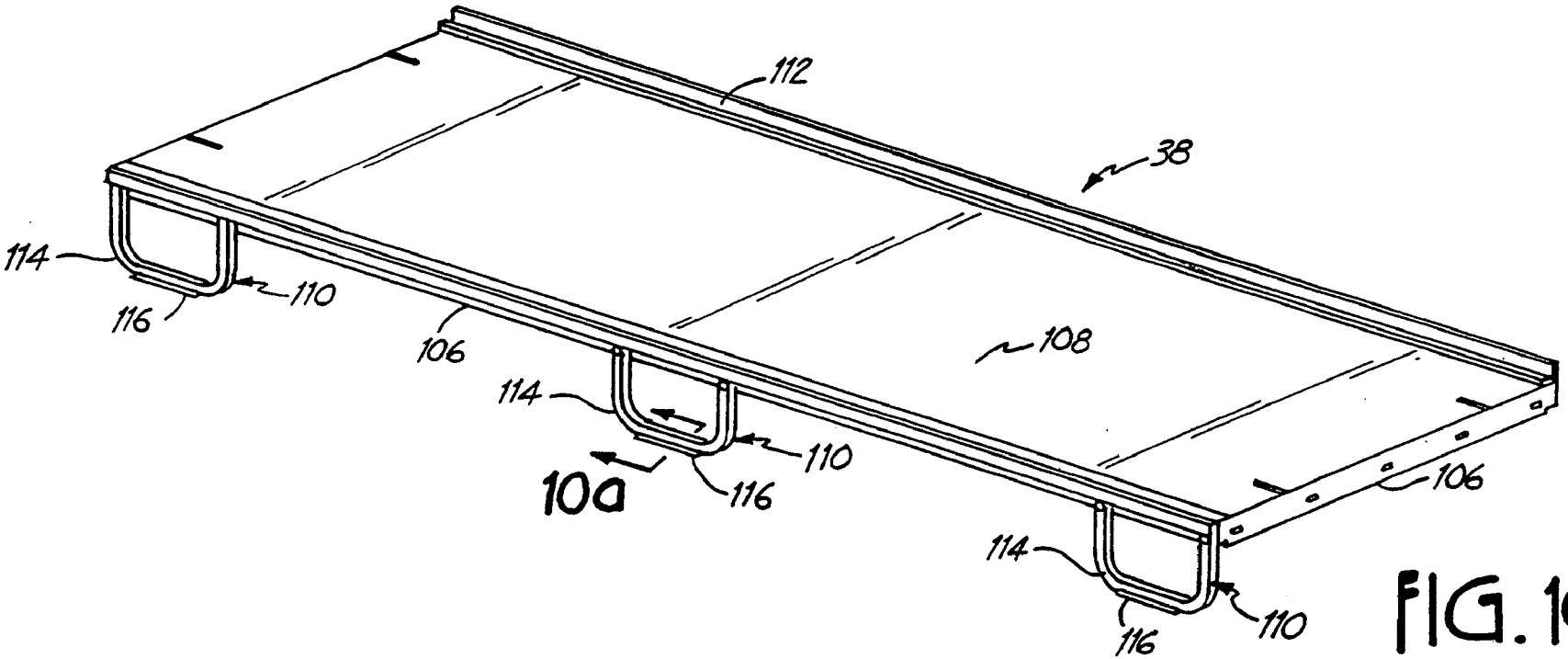
FIG. 10 is a top perspective view of a typical platform assembly as utilized in the present invention.
Figure 10A:
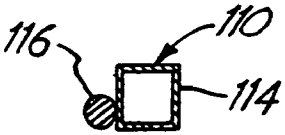
FIG. 10*a* is a sectional view of a leg as practiced in the present invention taken along section plane A—A in FIG. 10.
Figure 11:
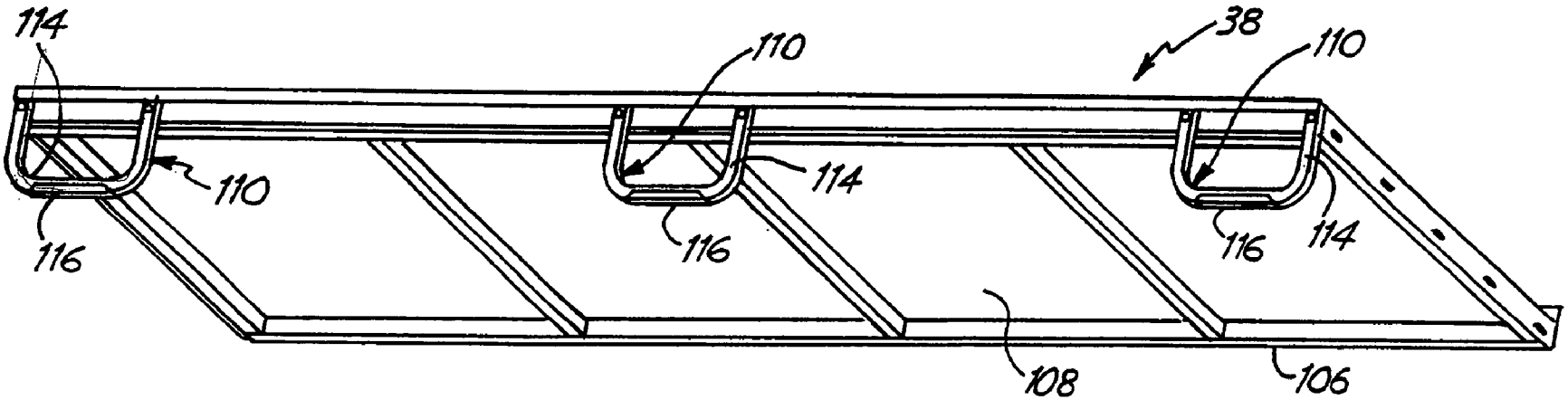
FIG. 11 is a bottom perspective view of a platform assembly.
Figure 16:
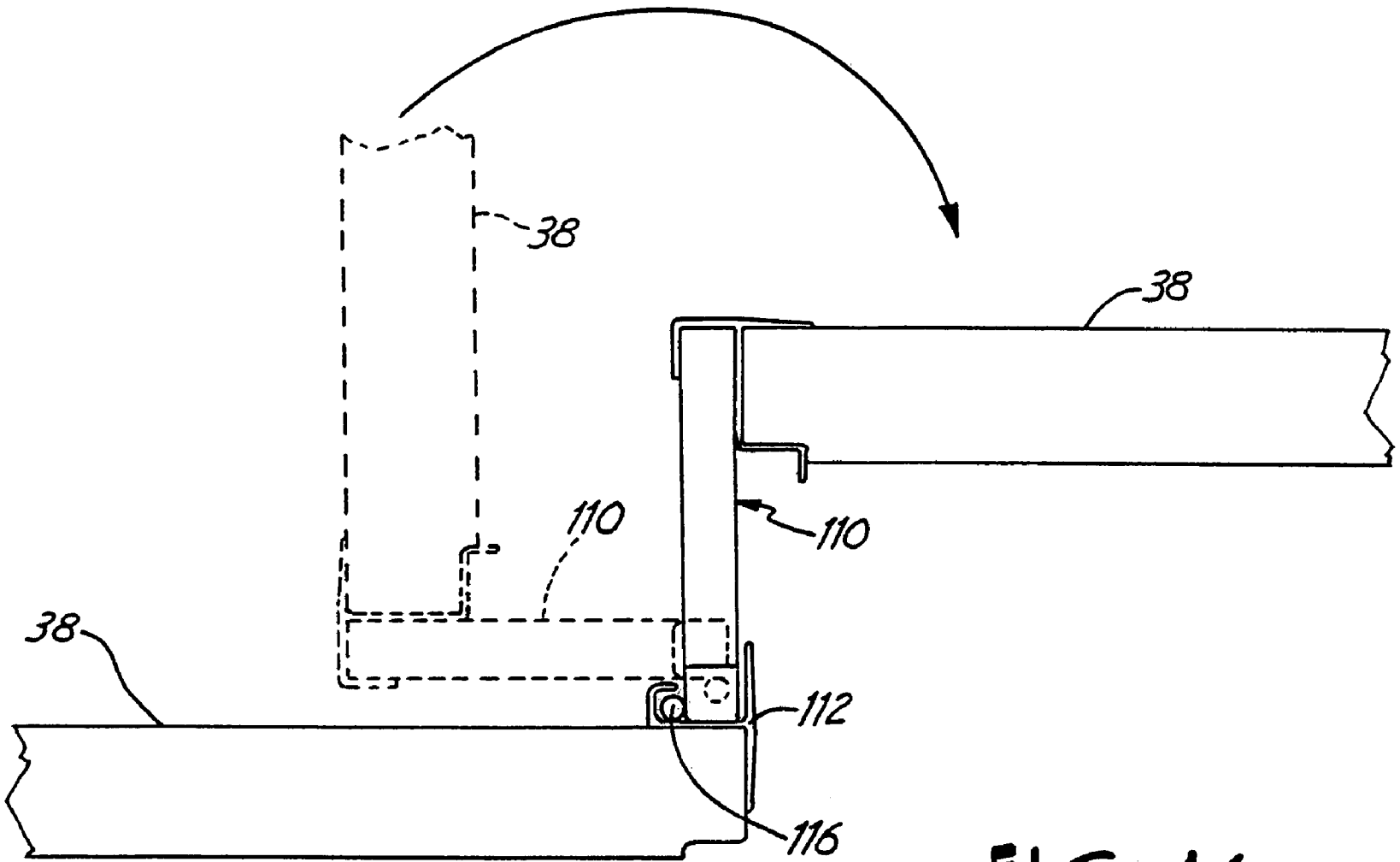
FIG. 16 is an end plan view showing the assembly of one platform interlocking with another platform as utilized in the present invention.
Figure 17:
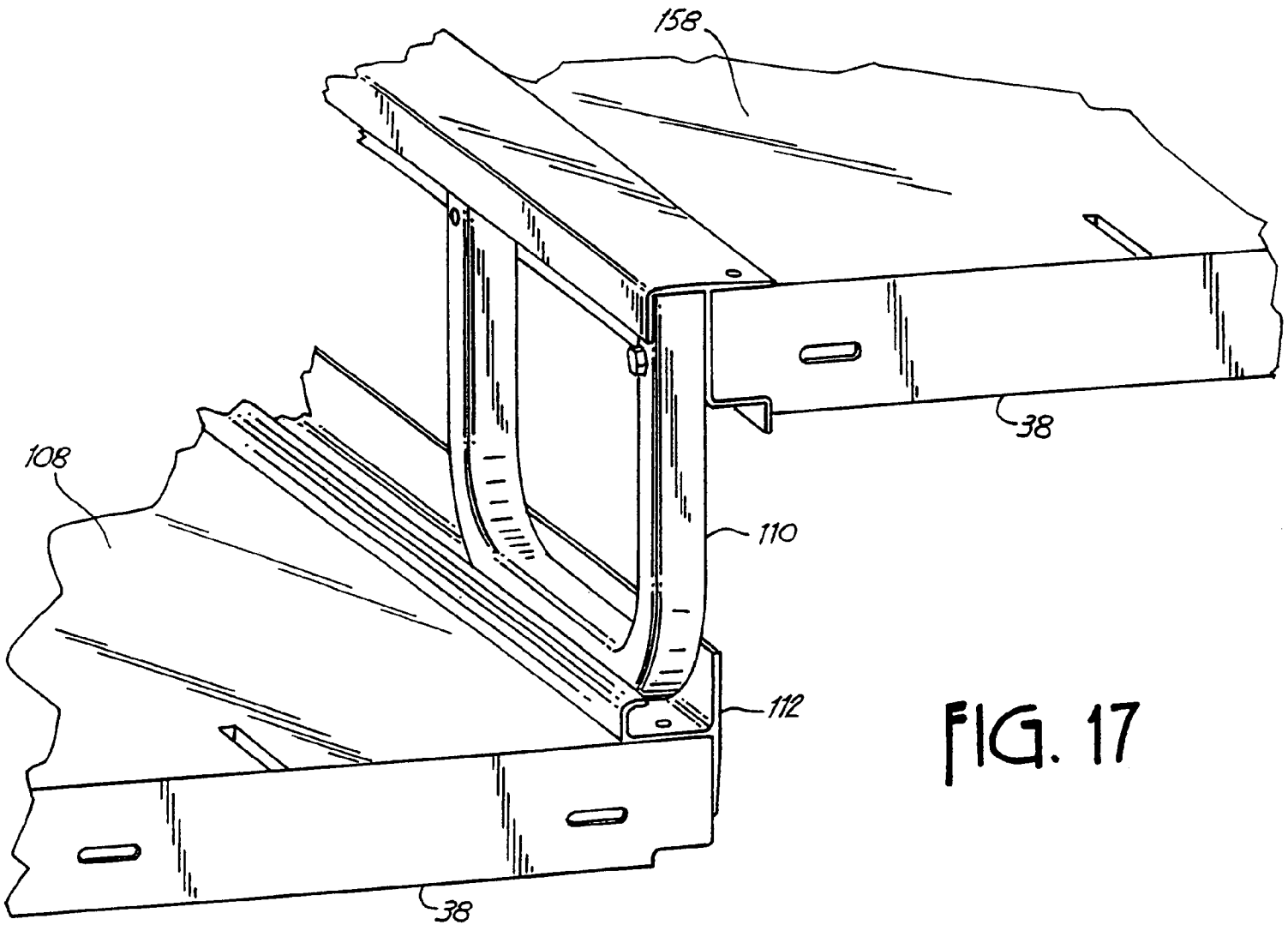
FIG. 17 is a perspective view of two platforms in an interlocked position.

Referring to FIGS. 10 and 11, platform 38 generally comprises frame 106, top sheet 108, legs 110, and leg receiver 112. Legs 110 are located at the front margin of platform 38 and include tubular U-member 114 and retainer bar 116. Leg receiver 112 is located at the rear margin of platform 38 and is configured to receive legs 110 as depicted in FIGS. 16 and 17. Leg receiver 112 is preferably constructed from an aluminum extrusion but may be formed of bent steel or by any other technique known in the art. Some configurations of the audience seating system 30 may also employ some platforms that lack legs 110 if some levels have an exceptionally large run. For example, if a large flat staging area is desired.

Figure 13:
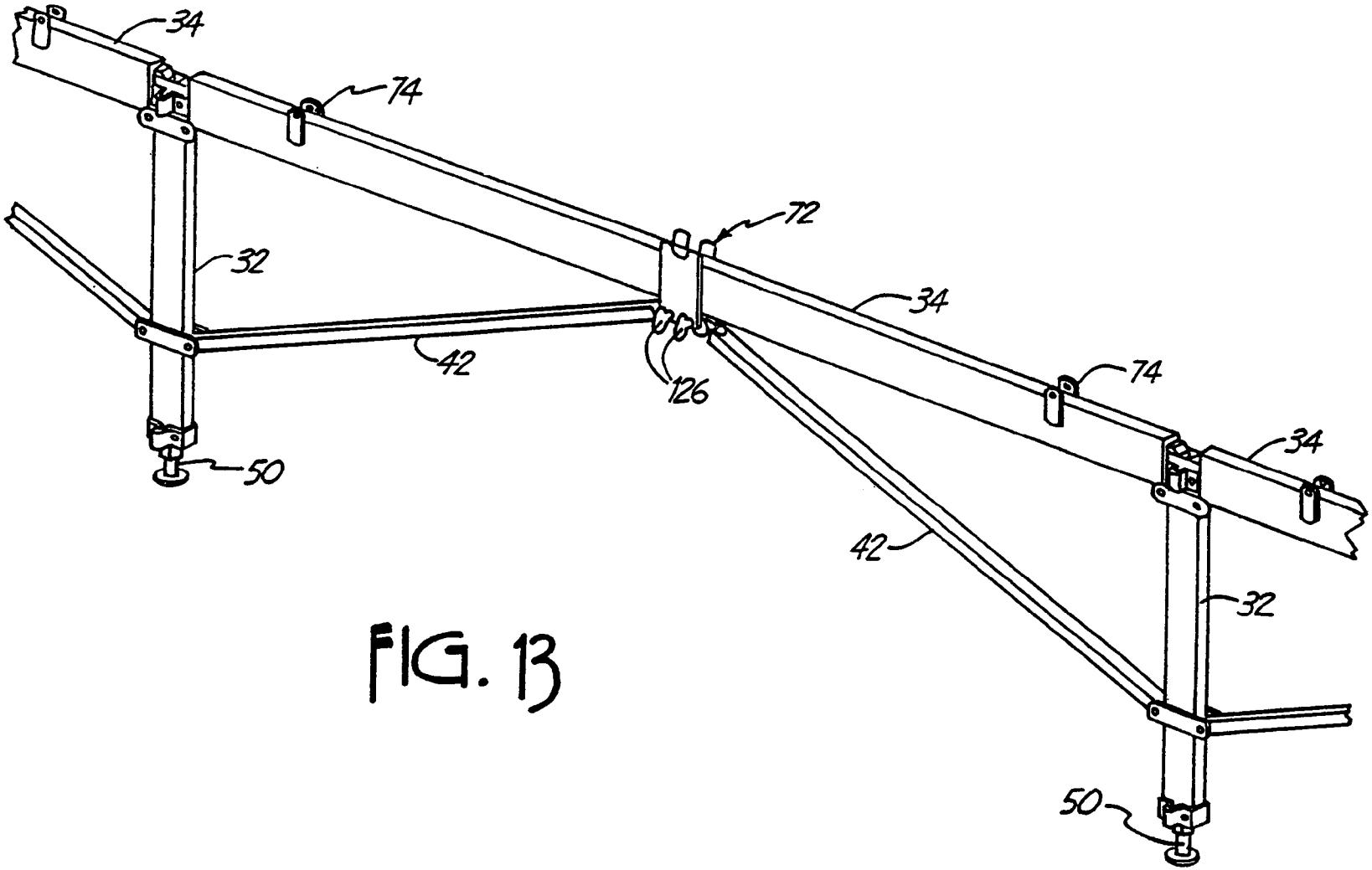
FIG. 13 is a perspective view of a typical truss and column assembly as utilized in the present invention.
Figure 14:
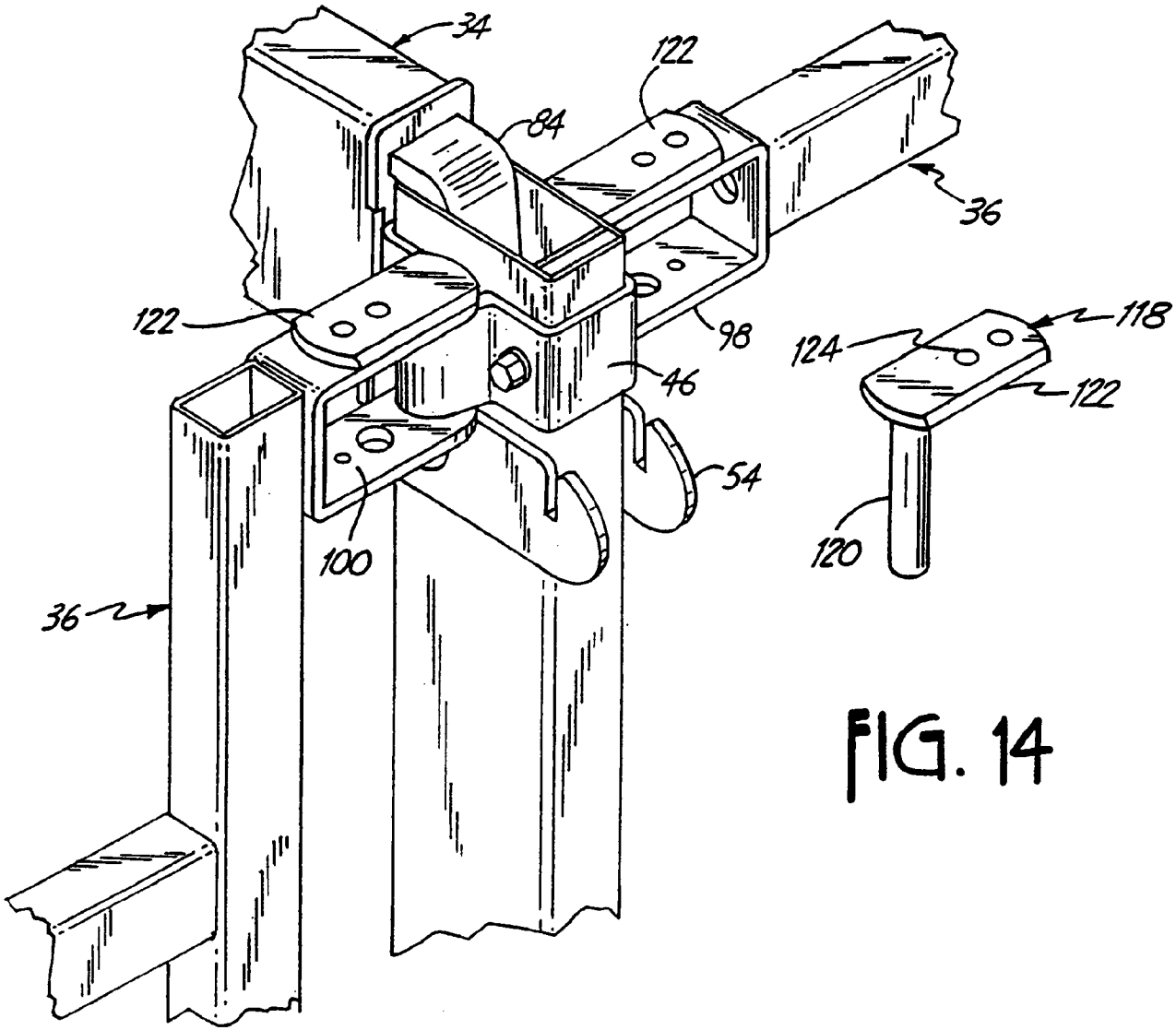
FIG. 14 is a perspective view of a typical truss, column and end frame assembly.

Additional components of system 30 are shown in FIGS. 13 and 14 and include vertical pin 118 and truss pin 126.Vertical pin 118 includes shaft 120 and head 122. Head 122 may be pierced by retaining holes 124. Referring to FIG. 13, truss pin 126 may be a conventional pin optionally securable in place by a fastener (not shown) or spring retainer (not shown). Truss pin 126 may also be retained by a lanyard (not shown) if desired.

Figure 12:
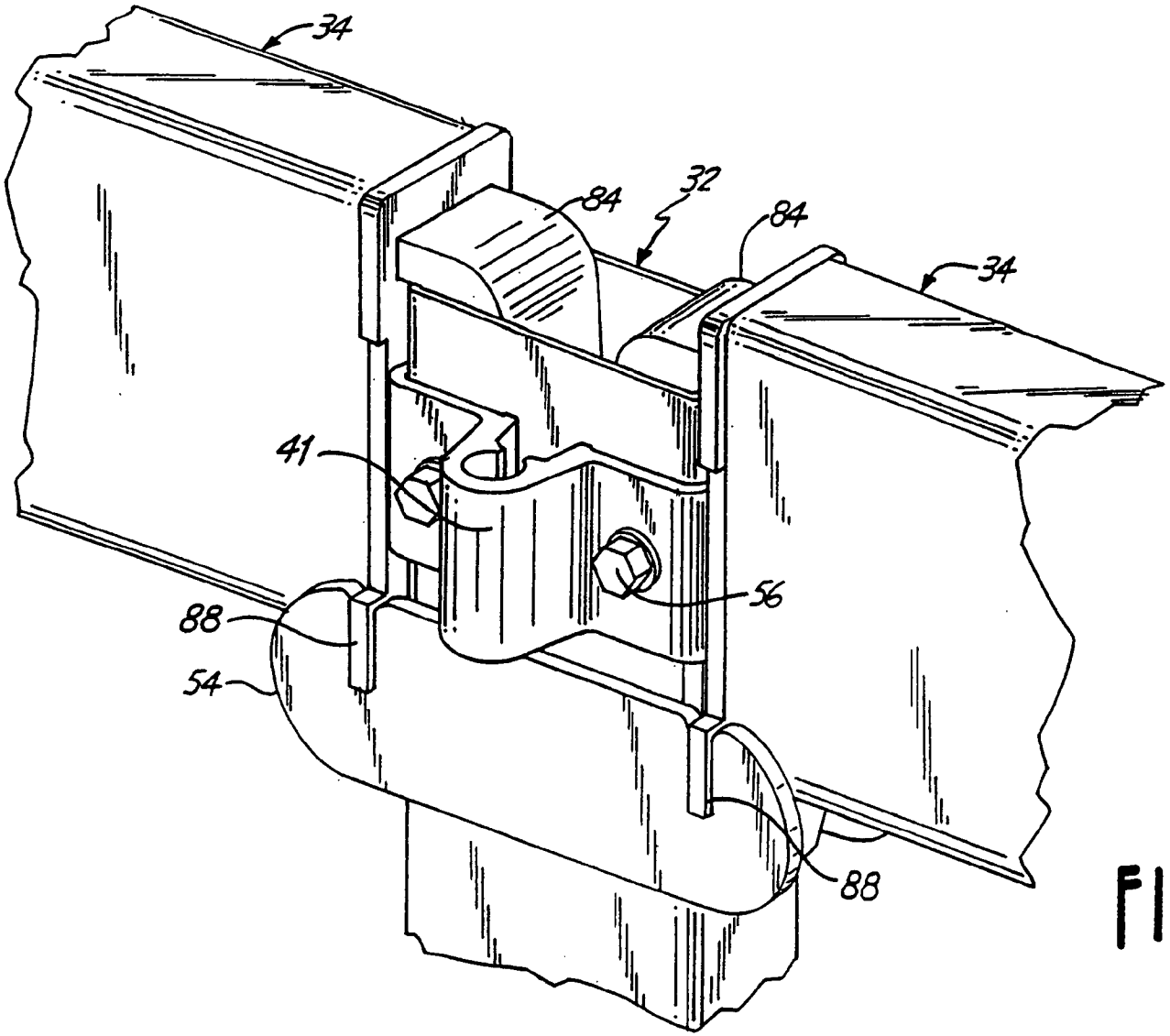
FIG. 12 is a detail perspective view of an interconnection between trusses and columns in the present invention.

FIGS. 12–17 generally depict the operational assembly sequence of the audience seating system 30. Referring to FIG. 12, trusses 34 are engaged to columns 32 by inserting hook 84 and end tabs 88 into hanger assembly 44 of column 32 whereby hook receiver 52 and hanger bracket 54 are engaged. Referring to FIG. 13, after trusses 34 have been engaged to columns 32, sway braces 42 are engaged to center bracket 72 and secured by truss pins 126.

Figure 15:
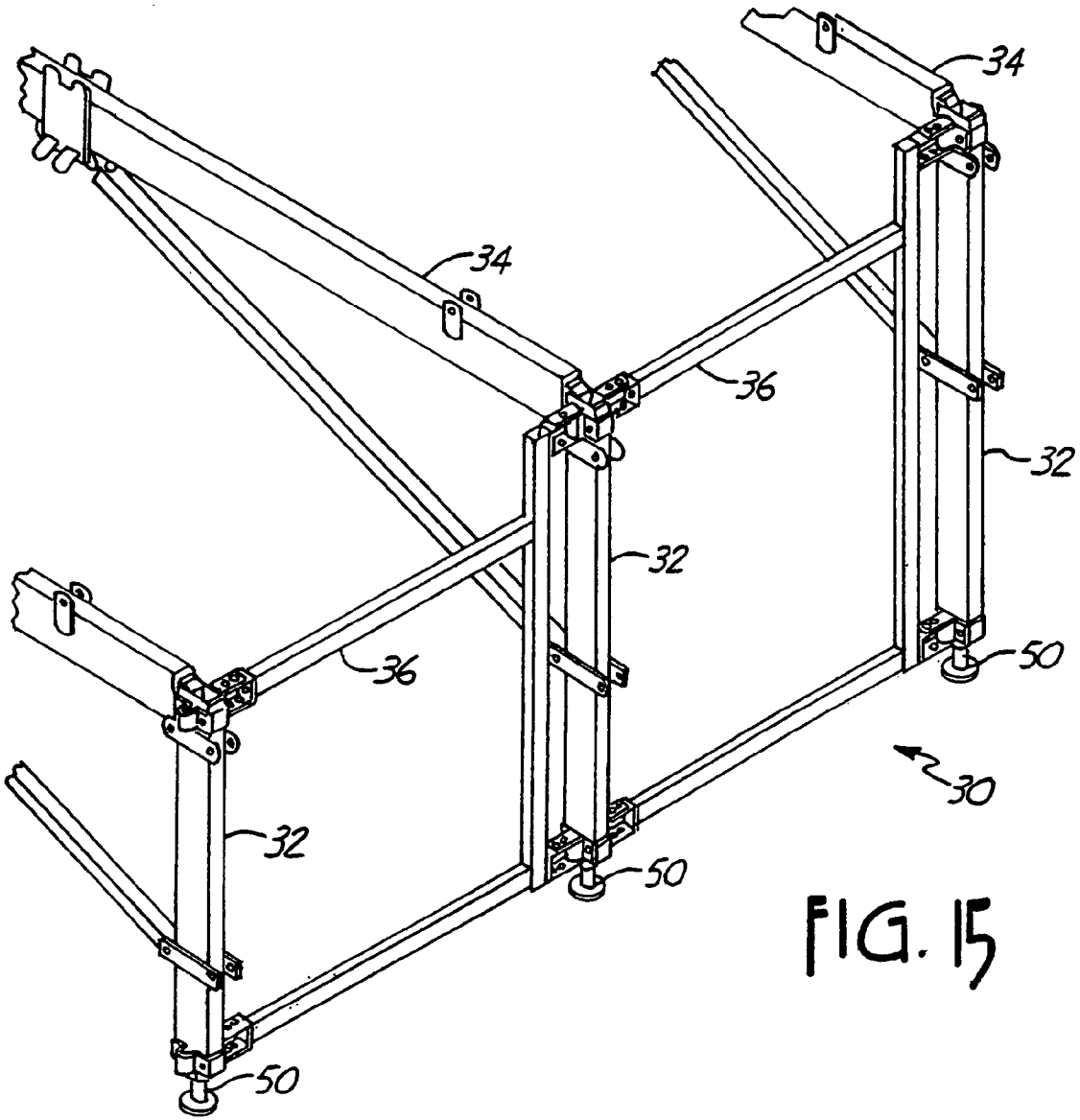
FIG. 15 is perspective view of several trusses, columns, and end frames as typically assembled.

Referring to FIGS. 13 and 14, end frames 36 are then connected to top bracket 46 of columns 32 and secured by vertical pin 118. All of brackets 96 of end frames 36 are engaged to columns 32 in a similar fashion. If desired, vertical pin 118 may be secured in place via retaining holes 124 by a wire tie (not shown) or other appropriate retaining device. Referring to FIG. 15, a series of trusses 34, columns 32 and end frame 36 are depicted as assembled.

Once the stage of assembly depicted in FIG. 15 is reached levelers 50 may be used to level the assembly by adjusting screw jack 60 to an appropriate height.

Referring to FIGS. 1 and 16, platforms 38 are placed preferably starting at the lowest level. Referring particularly to FIG. 16, platforms 38 interlock one with another by engaging legs 110 and retainer bar 116 into leg receiver 112 of the next lowest platform 38. Each platform 38 secures to the next lower platform 38 by shifting it from a vertical position to a horizontal position as depicted in FIG. 16 between the ghost image and the solid line image. Referring now to FIG. 17, a pair of platforms 38 is depicted as engaged for use.

After the audience seating system 30 is assembled in a desired configuration chairs (not shown) or other fixtures may be placed on platforms 38 as desired.

The selection of columns 32 of various heights and platforms 38 and endframes 36 of various widths allows great flexibility in the design of the audience seating system 30 ultimately assembled from the disclosed components. It is possible to configure a system 30 with uniform rises and runs throughout any number of levels. Additionally, it is possible to configure a system 30 with various runs by varying the dimensions of platforms 38 and endframes 36.

It is also possible to create a system 30 with varying rises in different levels of the system by varying the height of columns 32 and legs 110. Further, the number of levels is readily configurable by the addition or deletion of rows of columns 32, trusses 34 and platforms 38. Thus the audience seating system 30 is readily configurable to accommodate a great variety of needs by appropriate selection and combination of the various modular components.

Figure 18:
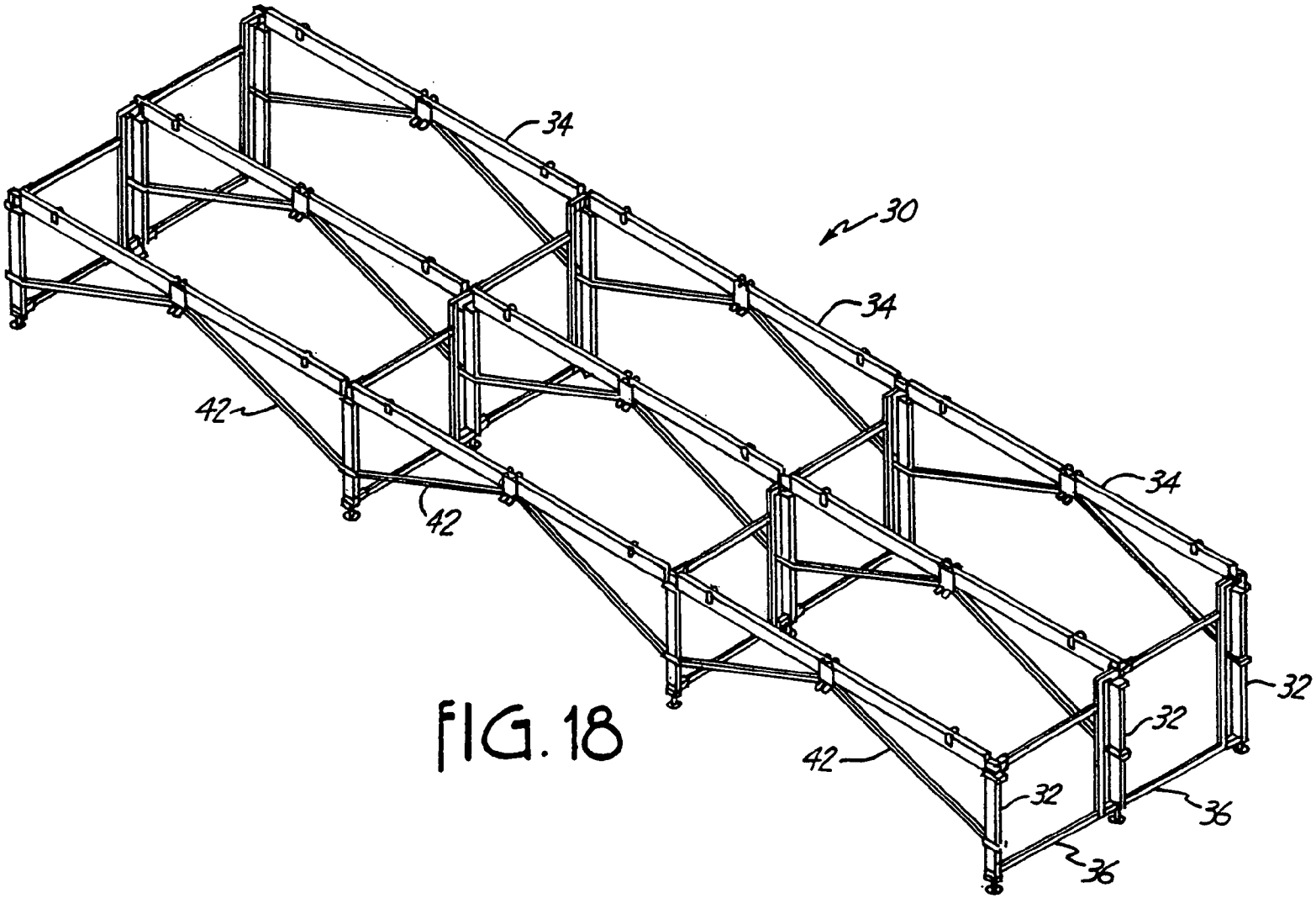
FIG. 18 is a perspective view of a typical partial assembly for intermediate levels of the audience seating system, without platforms.
Figure 19:
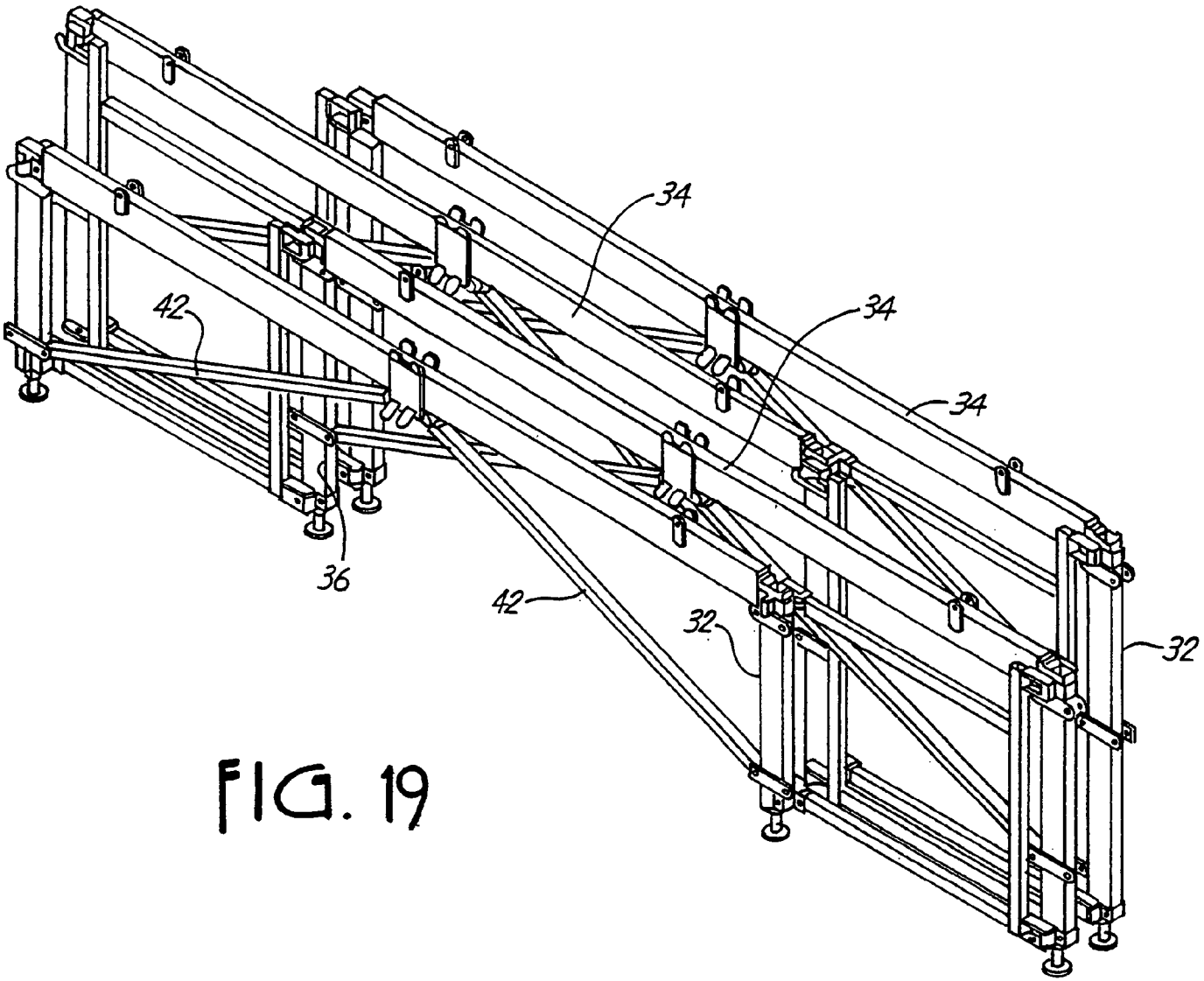
FIG. 19 is a perspective view of a truss, column and end frame assembly folded for storage.

The audience seating system 30 may be disassembled in part or in whole for storage and transport. Referring to FIG. 18, a typical audience seating system 30 assembly of intermediate levels is shown. One option for storing the audience seating system 30 is to fold the system by pivoting the system about vertical pins 118. Referring to FIG. 19, a sub-assembly folded in this configuration is shown.

Figure 20:
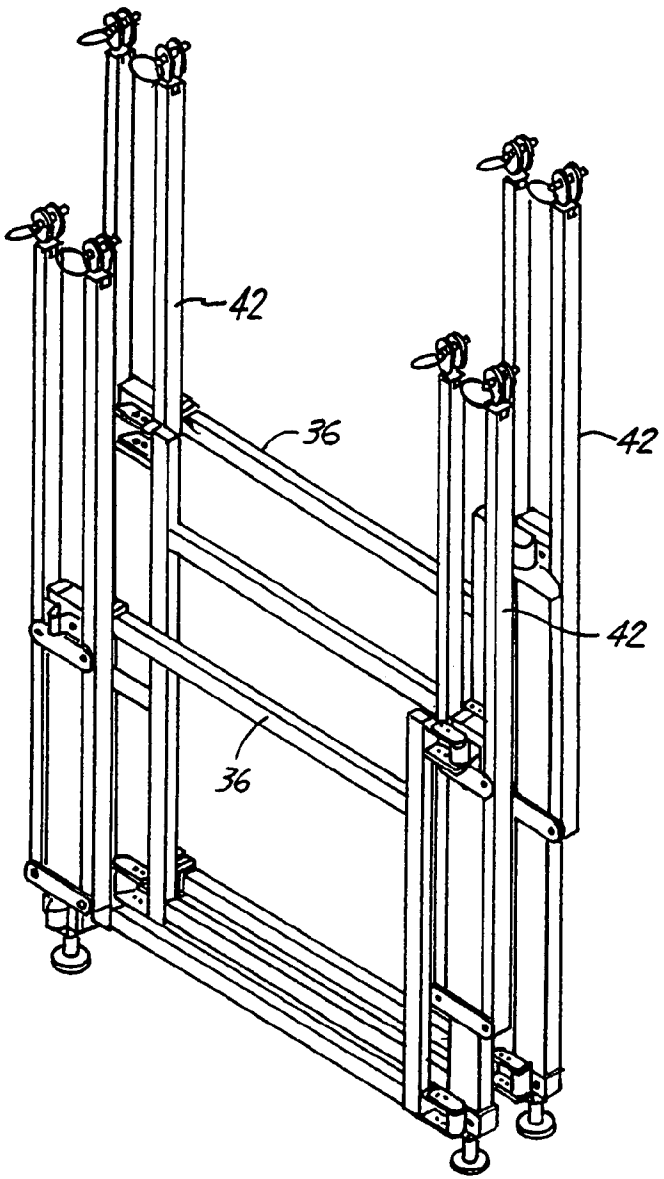
FIG. 20 depicts columns and end frames at an alternate level of disassembly and folding for storage.

Referring to FIG. 20, an alternate storage configuration is shown. In this configuration, columns 32 and end frames 38 are separated from trusses 34 while still leaving columns 32 and end frames 36 connected. By pivoting the columns 32 about vertical pins 118 this folding configuration may be achieved.

The present invention may be embodied in other specific forms without departing from the spirit of the essential attributes thereof; therefore, the illustrated embodiments should be considered in all respects as illustrative and not restrictive, reference being made to the appended claims rather than to the foregoing description to indicate the scope of the invention.

We claim:

1. An interface for connecting supporting members of an audience seating system, the supporting members comprising a horizontal member having a long axis, a first end and a second end and a vertical member comprising an upper end and a lower end, the interface comprising:

an end plate secured to the first end of the horizontal member, the end plate comprising a downwardly extending tongue and outwardly extending tabs;

a hook member extending outwardly and downwardly from the first end of the horizontal member;

the upper end of the vertical member including structure defining a recess dimensioned to receive the hook member therein and including a hanger bracket below the recess, the hanger bracket defining a space for receiving the tongue and openings for receiving the tabs;

whereby the horizontal member may be engaged to the vertical member by lowering the hook member into the recess, the tongue into the space and the tabs into the openings to create a substantially rigid engagement.

2. The interface of claim 1, further comprising a rounded hook receiver within the recess.

3. The interface of claim 1, wherein the vertical member further comprises a top bracket supporting a pin receiver.

4. The interface of claim 1, further comprising an end frame including front and rear end frame brackets connected by intervening structure, at least one of the end frame brackets being engageable with the top bracket.

5. The interface of claim 1, further comprising an end frame including front and rear end frame brackets connected by intervening structure, at least one of the end frame brackets being engageable with the top bracket.

6. An interface for connecting supporting members of an audience seating system, the supporting members comprising a truss having a long axis, a first end and a second end and a column comprising an upper end and a lower end, the interface comprising:

an end plate secured to the first end of the truss, the end plate comprising a downwardly extending tongue and outwardly extending tabs;

a partially curved hook member extending outwardly generally along the long axis and downwardly and outwardly from the first end of the truss;

the upper end of the column defining a recess dimensioned to receive the hook member therein and comprising a rounded hook receiver within the recess and a hanger bracket below the recess, the hanger bracket defining a space for receiving the tongue and slots for receiving the tabs;

whereby the truss may be engaged to the column by lowering the hook member into the recess, the tongue into the space and the tabs into the slots and the hook members and the hook receivers act together to draw the truss tightly to the column to create a substantially rigid engagement.

7. The interface of claim 6, wherein the vertical member further comprises a top bracket supporting a pin receiver.

8. The interface of claim 6, further comprising an end frame including front and rear end frame brackets connected by intervening structure, at least one of the end frame brackets being engageable with the top bracket.

9. The interface of claim 6, further comprising a sway brace engageable to the horizontal member at a location between the first end and the second end and engageable to the vertical member near the lower end.

10. An audience seating system, comprising:

an interface for connecting supporting members of the audience seating system, the supporting members comprising a horizontal member having a long axis, a first end and a second end and a vertical member comprising an upper end and a lower end, the interface comprising:

an end plate secured to the first end of the horizontal member, the end plate comprising a downwardly extending tongue and outwardly extending tabs;

a hook member extending outwardly and downwardly from the first end of the horizontal member;

the upper end of the vertical member defining a recess dimensioned to receive the hook member therein and comprising a hanger bracket below the recess, the hanger bracket defining a space for receiving the tongue and openings for receiving the tabs;

whereby the horizontal member may be engaged to the vertical member by lowering the hook member into the recess, the tongue into the space and the tabs into the openings to create a substantially rigid engagement.

11. The audience seating system of claim 10, further comprising a rounded hook receiver within the recess.

12. The audience seating system of claim 10, wherein the vertical member further comprises a top bracket supporting a pin receiver.

13. The audience seating system of claim 10, further comprising an end frame including front and rear end frame brackets connected by intervening structure, at least one of the end frame brackets being engageable with the top bracket.

14. The audience seating system of claim 10, further comprising an end frame including front and rear end frame brackets connected by intervening structure, at least one of the end frame brackets being engageable with the top bracket.

* * * * *